United States Patent [19]

Synodis

[11] 3,947,907

[45] Apr. 6, 1976

[54] REMOTE CONTROLLED SCUTTLING BUOY

[75] Inventor: Steve T. Synodis, Morris Plains, N.J.

[73] Assignee: Exxon Research and Engineering Company, Linden, N.J.

[22] Filed: June 24, 1974

[21] Appl. No.: 482,416

[52] U.S. Cl. ..... 9/8 R; 114/230; 251/61.4; 251/131; 294/84

[51] Int. Cl.[2] ..... B63B 21/52

[58] Field of Search ..... 9/8 R, 8 P, 9; 114/230, 114/235 A, 197, 198, 50, 51, 52, 53, 16 E; 137/236; 251/61.4, 131; 294/83 R, 84

[56] References Cited

UNITED STATES PATENTS

| | | | |
|---|---|---|---|
| 2,443,629 | 6/1948 | Matuszewski | 114/235 A |
| 2,559,692 | 7/1951 | Whalen | 251/61.4 |
| 3,259,418 | 7/1966 | Munday et al. | 294/83 R |
| 3,512,493 | 5/1970 | Hallanger | 9/8 R |
| 3,556,170 | 1/1971 | Bily | 114/230 |
| 3,570,437 | 3/1971 | Davis et al. | 9/8 R |
| 3,613,070 | 10/1971 | Jones et al. | 251/131 |
| 3,637,187 | 1/1972 | Burger | 251/61.4 |
| 3,811,720 | 5/1974 | Epstein | 294/84 |
| 3,860,983 | 1/1975 | Furth et al. | 9/8 R |

*Primary Examiner*—Trygve M. Blix
*Assistant Examiner*—Charles E. Frankfort
*Attorney, Agent, or Firm*—F. Donald Paris

[57] ABSTRACT

A berthing buoy for mooring ships which provides for remote controlled release of mooring lines in emergency situations and sinking of the buoy by opening special scuttling valves. The buoy is refloated by blowing its compartments with compressed air manually admitted to the compartments by a diver using a special control station.

10 Claims, 5 Drawing Figures

REMOTE CONTROLLED SCUTTLING BUOY

BACKGROUND OF THE INVENTION

Large seagoing vessels, in particular large tankers, are often moored offshore in deep water for loading through underwater pipelines or hoses. One type of mooring system in common use is a multiple buoy sea berth. In such a system, anchored buoys define an area in which a ship is positioned, secured there by the buoys and by its own anchor system. The sea berth is located so that it takes account of the prevailing sea conditions and winds in the particular area. Accordingly, a ship in the berth is always facing in the same direction no matter what the currents or winds actually are at any particular time. Under adverse conditions, it may be necessary for a ship to leave such a berth quickly in order to avoid possible damage to the ship or to the loading facilities. At such times, it is necessary to cast off from each of the buoys and get under way very promptly. If, in this process, the ship should contact one or more of the buoys, there is a distinct possibility of disabling damage to the ship, requiring major repairs before it can be put back in service. Because of this danger, which is inherent in a multiple buoy sea berth, such facilities should be designed to make possible a rapid departure when necessary. The present invention makes a rapid departure from a multiple buoy sea berth possible by remote control releasing of the tanker and a self-scuttling of the buoys.

SUMMARY OF THE INVENTION

The self-scuttling buoy of the invention may be either designed specifically for the purpose or adapted from the conventional buoys presently used for such berths. In order to sink the buoy, novel scuttling valves are provided which admit sea water to the buoy and vent air from its interior. These valves are opened by compressed air carried in cylinders on the buoy and actuated through a special control system at the direction of a remote operated radio transmitter from the tanker or the shore. Facilities are also provided for later recovery of the buoy by a diver, who introduces air from an external source to the buoy and displaces water to gradually refloat the buoy.

BRIEF DESCRIPTION OF THE DRAWINGS

FIG. 3 illustrates schematically the arrangement of the buoy scuttling and recovery system.

DESCRIPTION OF THE PREFERRED EMBODIMENTS

Figure 1:
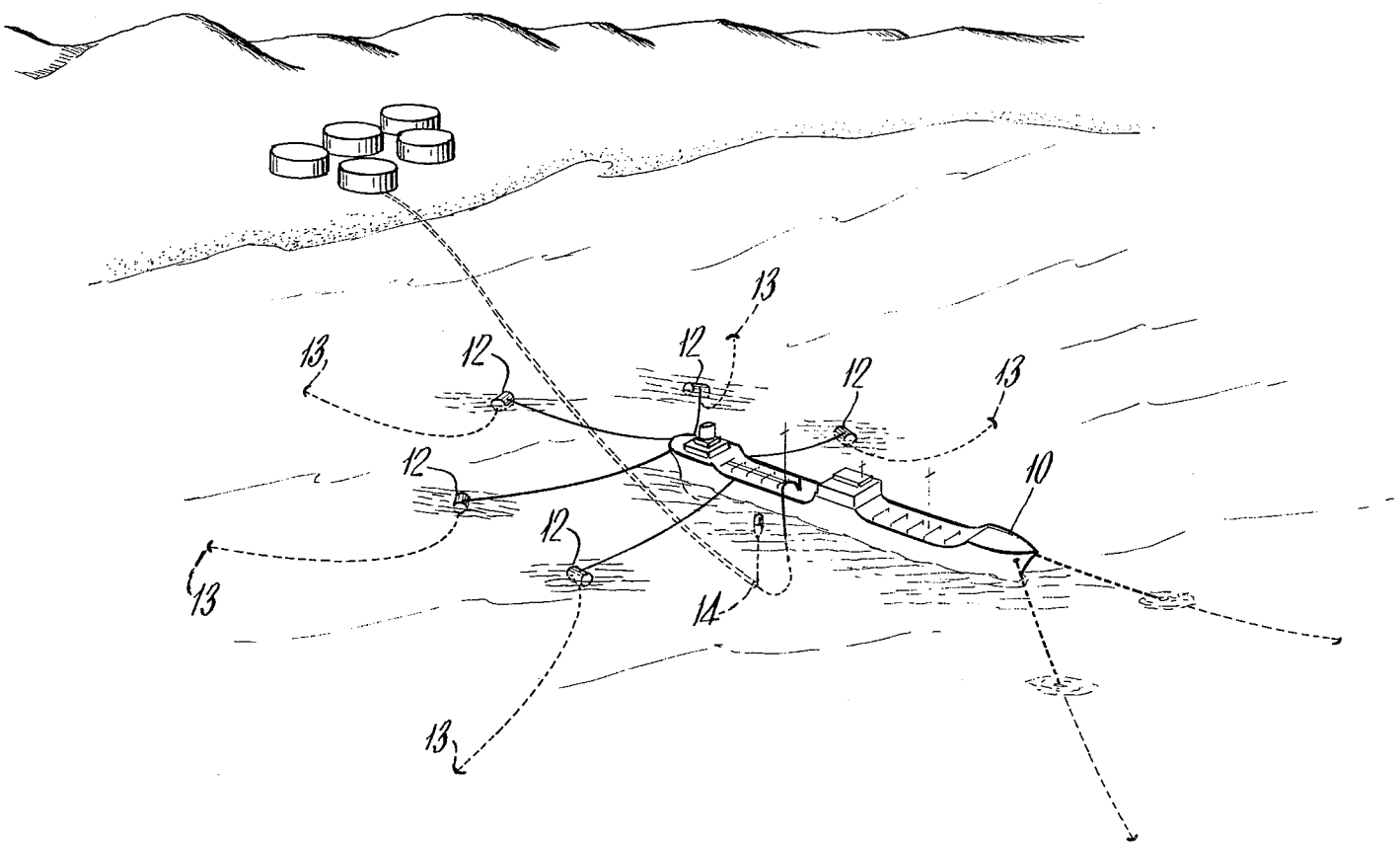
FIG. 1 illustrates a typical multiple buoy sea berth with a tanker moored therein.

FIG. 1 illustrates a typical multiple buoy sea berth with a tanker positioned therein. The tanker is receiving cargo in this illustration from shore facilities through undersea hoses. The tanker 10 is located in a fixed position that is established by the buoys 12 which in themselves have been located adjacent to the ends of the undersea hoses 14 in accordance with the prevailing weather and sea conditions in the particular loading area. As has been mentioned earlier, the ship typically will maneuver into such a sea berth in a position approximately equidistant from the buoys. The ship 10 is moored to the buoys 12, which are fixed in position by their anchors 13. Mooring is accomplished by a work boat or launch fastening the ships mooring lines to the buoys. It will be appreciated that the effort involved to disengage the ship 10 from the buoys 12 will be significant and time consuming, which makes it difficult for a ship 10 to leave the sea berth quickly should conditions require it. However, it often happens that changes in weather or other emergency conditions make such departures necessary. There is a good possibility that the ship will contact one of the mooring buoys 12, causing severe damage to itself as well as to the buoys. The possibilities for damage are great inasmuch as typical buoys for mooring large ships (as much as 200,000 DWT) would be approximately 24 feet across, 11 feet in height and weigh approximately 22 tons.

The cost of such potential damage being very great, provision should be made to minimize the possibility of such damage. One technique which may be used is to scuttle selectively some or all of the buoys 12 at the time the ship is required to leave in order to avoid any contact of the ship with the buoys. The present invention makes this possible by providing facilities for automatically disengaging the ship 10, scuttling the buoys 12 for later recovery. The recovery of the buoys 12 is less urgent than the rapid disengagement from the ship 10, and it is preferable to provide a semi-manual recovery system, which will be described hereinafter, rather than to attempt an automatic recovery.

The buoys 12 are supported by air inside their compartments. Accordingly, it is possible to sink the buoys 12 by simply admitting water and venting the air from the compartments. While this could be done manually, it is obviously not a quick method of scuttling the buoys under emergency conditions. A special valve which is a part of the invention and which will be discussed in more detail later, makes possible rapid scuttling of the buoy when actuated by a remote command.

Figure 2:
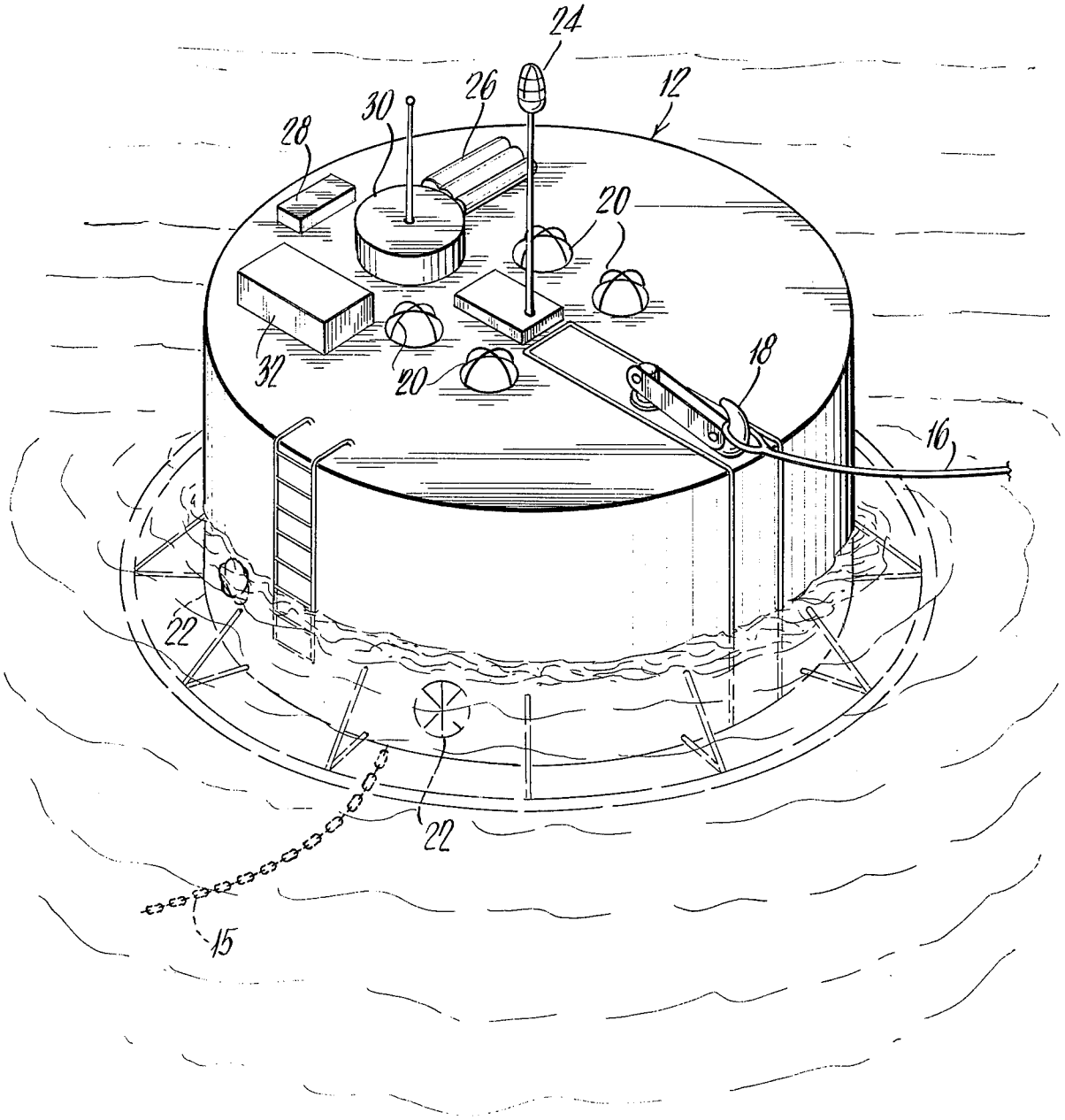
FIG. 2 shows a buoy according to the invention in a perspective view.
Figure 5:
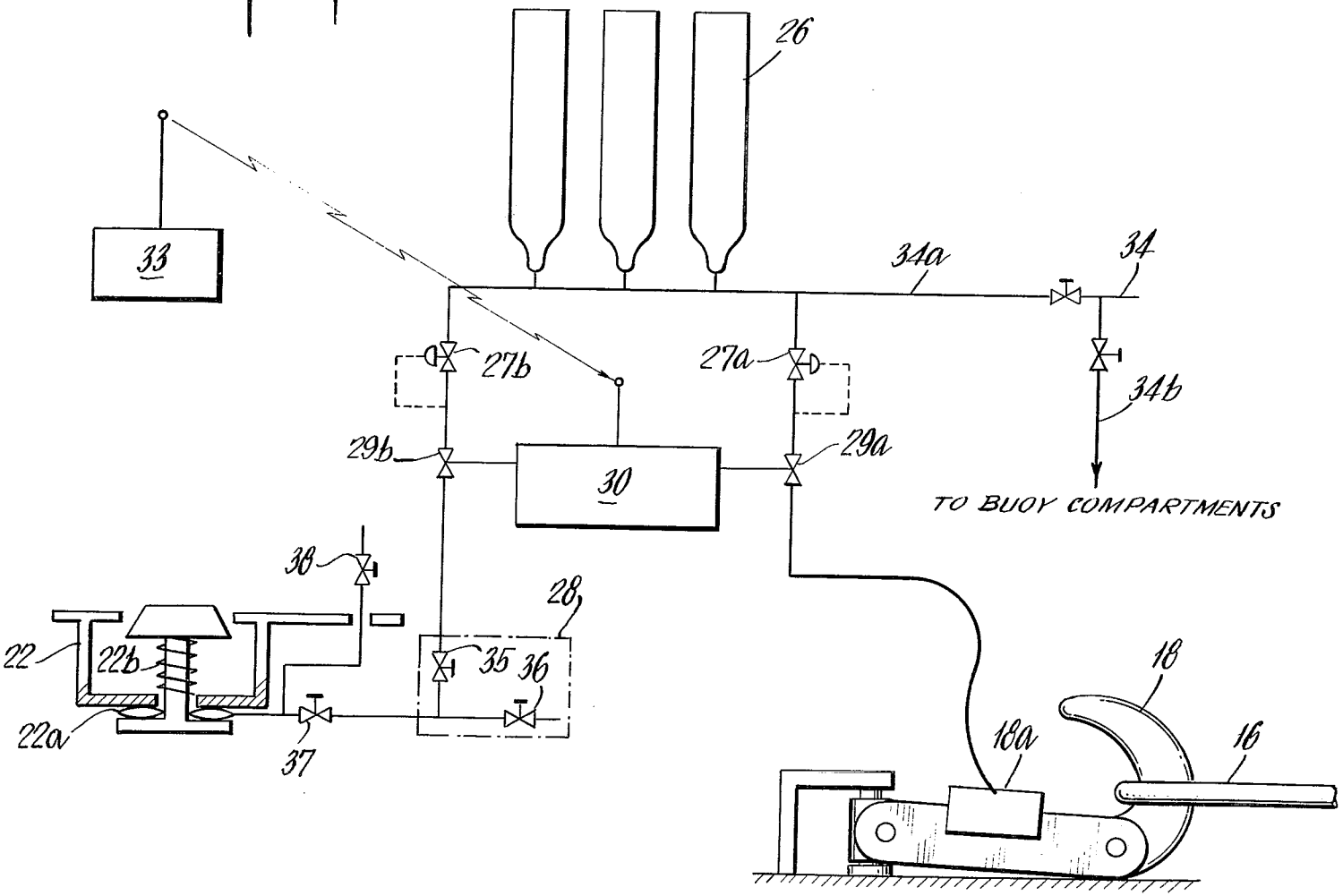

The buoy 12, according to the invention, is illustrated in perspective in FIG. 2. The buoy 12, which floats in an area limited by its mooring chain 15 secures the tanker in position by means of a hawser 16 from the ship which is connected to a mooring hook 18 on the buoy's upper surface. Air venting valves 20 on the top of the buoy 12 are used to vent air inside the buoy's compartments when sea water is admitted through the submerged valves 22. A navigation light 24 is also provided on the upper surface of the buoy. The valves 20 and 22 are actuated by high pressure air contained in cylinders 26 located on the upper surface of the buoy 12 and connected to both the air venting valves 20 and sea water flooding valves 22. Air from cylinders 26 is admitted to the valves 20 and 22 and also to an air-operated actuator 18*a* (*see* FIG. 3) of the conventional type such as disclosed in prior art U.S. Pat No. 3,259,418, as well as other conventional types of air-operated actuators which employ pneumatic cylinder pistons driven in the direction so as to release or reset the hook mounted on the mooring hook 18 for disengaging the hawser 16 upon command from the ship, thereby releasing the ship and scuttling the buoy. The signal receiver 30 provides a means for receiving a signal from the ship or the shore and actuating the emergency air scuttling system. A control center 28 is provided for refloating the buoy under semi-manual control of a diver, as will be discussed later. Batteries 32 are necessary for operation of the electrical portion of the facilities and also are located on the upper surface of the buoy 12.

FIG. 3 illustrates schematically the interconnection of the elements just described. The mooring hook 18, which is used to connect the ship to the buoy by mooring line or hawser 16, can be released through means of an air cylinder operator 18*a* connected to the air supply system. The scuttling valve 22 can be opened by air inflation of an expandable operator to flood the buoy with sea water. A vent valve according to the invention is constructed similarly to the scuttling valve 22, but its position is reversed from that shown since it relieves internal air pressure. Air is supplied from air cylinders 26 operating at approximately 2200 psig in order to actuate the mooring hook release 18*a* and to scuttle the buoy.

Pressure regulators 27 are provided to reduce the air pressure from the high level in the air cylinders to that required for operation of the mooring hook release 18*a* and vent/scuttling valves 20 and 22. Automatic valves 29 are provided in the air system which admit the reduced pressure air to the valves and hook release when commanded to do so by the radio receiver and actuator 30. This radio receiver and actuator 30 responds to a command from a radio transmitter 33, generally located on the tanker, although shore or work boat facilities could also be used for this purpose. A connection 34 is also provided for introducing supplementary air, both for recharging the air cylinders 26 through connection 34*a* and for refloating the buoy 12 after it has been scuttled through connection 34*b*. Each of the vent/scuttle valves 20 and 22 is actuated in the preferred embodiment by an expandable operator 22*a* disposed between a movable and fixed portion of the valve. When air is admitted to the interior of the operator 22*a* it forces the valve to open against the force of spring 22*b*, which trys to close the valve.

Upon receiving a signal from the radio transmitter 33 to actuate the valves 20 and 22, air is admitted to the operator 22*a* of each of the valves and air is vented from the top of the buoy and water is admitted through the bottom. Depending upon the rate at which this is done, it is possible that the buoy could become irregularly flooded internally causing it to shift in position as it sinks. This could result in the buoy settling straight to the bottom of the sea, or could cause it to shift position and land on its side or even on its top. Thus, the refloating of the buoy could become complicated if automatic operations is sought and, accordingly, has been left to semi-manual control by a diver at the control center. A portion of the control center 28 associated with one of the valves is illustrated schematically in FIG. 3. Each valve 22 (and 20) has an air supply valve 35 and an air bleed valve 36, which permit the valve 22 to be opened or closed or stopped at an intermediate point therebetween. Multiple scuttling and vent valves are provided so that it is possible to control the purging of the interior of the buoy during the refloating operation and to position the buoy in its normal upright position and to control rise from the bottom to the surface. Each of the vent and scuttling valves 20 and 22 would be provided with local supply 37 and bleed 38 valves as well as supply 35 and bleed 36 valves at the control center 28. A diver would descend to the sunken buoy and, after viewing its position, would admit air to such valves as necessary to raise the buoy and position it as air is provided. Since the buoy is compartmented, it is possible to change the position of the buoy by selective purging of its compartments. Summarizing the operation of the self-scuttling buoy, it will be sunk by a radio command which energizes a valve 29*a* admitting air to the mooring hook air cylinder 18*a* causing the hook 18 to move conventionally into such a position that the ship's mooring line 16 is released. Following this, a second command from the radio transmitter 33 energizes the valves 29*b*, which admits air to the air operator 22*a* (and corresponding 20*a*) in each of the vent/scuttle valves 20 and 22, admitting water to the bottom of the buoy and venting air from the top. The buoy sinks as water floods into the buoy compartments and descends to the bottom of the sea typically about 100 feet in such sea berths. In order to refloat the buoy at a later time, divers descend to the buoy and close the air venting valves 20 by bleeding air from the operators 20*a* which hold the valves open. The divers then connect air tanks or an air hose from their service boat to the air manifold 34 on the buoy and use that air to expel water from the flotation compartments. The buoy then begins to rise and the diver controls the rate of ascent by venting ballast air from the buoy by control of the position of the vent valves, using the valves 35 and 36 at the control center 28. After the buoy has been fully raised, air is bled from the scuttle valve operators 22*a* so that they close and the buoy remains afloat. Thereafter, the air cylinders 26 can be recharged and the actuating equipment tested and reset for further use.

Figures 4A, 4B:
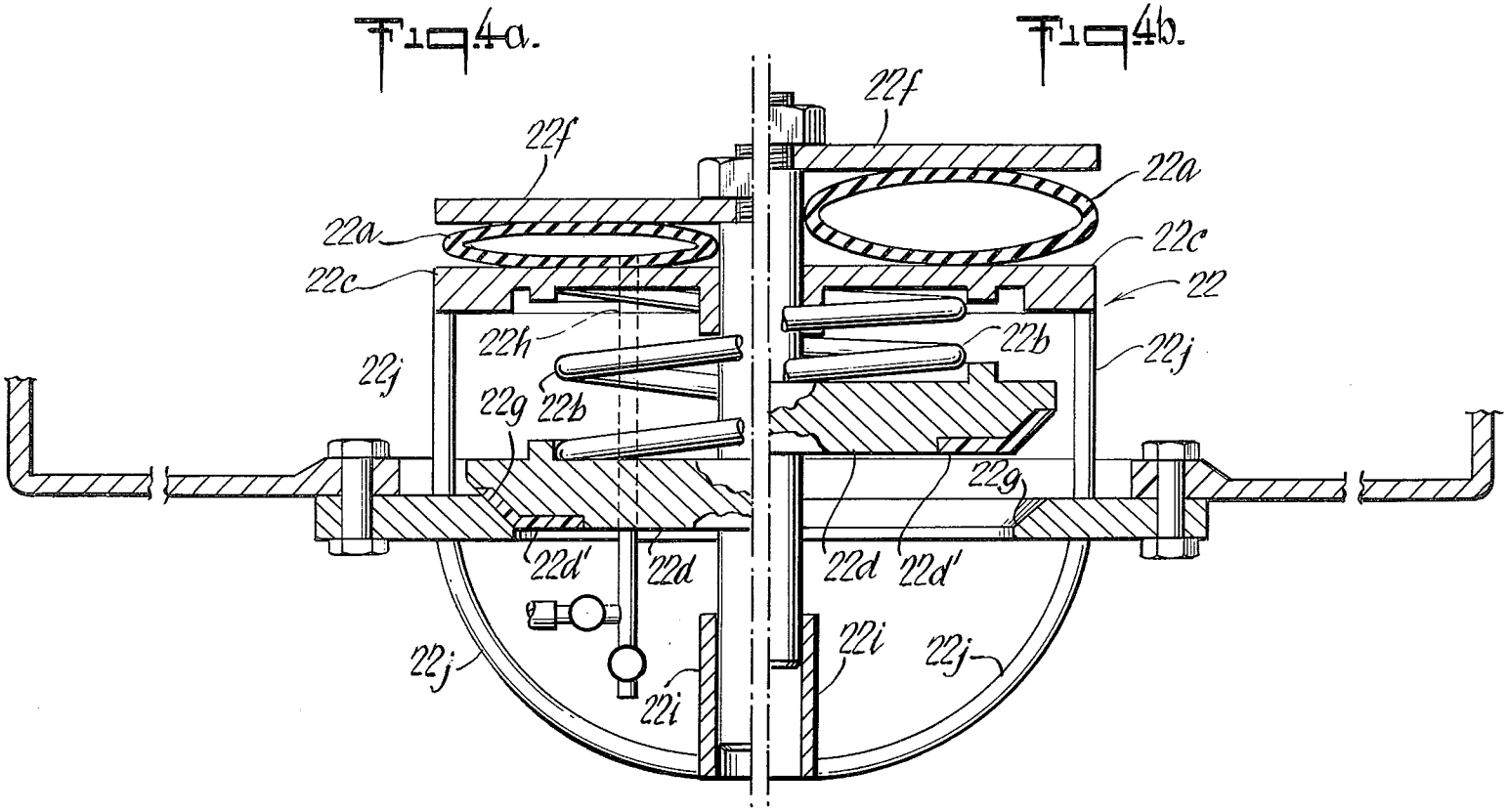
FIGS. 4*a* and 4*b* show the details of the special scuttling and air venting valve of the invention.

FIG. 4 illustrates the venting/scuttling valve of the invention. Valve parts will be designated as "22" series (a scuttling valve), but it will be understood that the venting valves 20 are substantially the same structure. The valve is mounted on the buoy either as a scuttling valve 22 or as a vent valve 20. The valve seat 22 with its soft closure material 22*d*, forms a tight seal to prevent in leakage of water (or escape of air from the buoy). The valve 22 is held in the closed position by spring pressure from spring 22*b* and it is opened by admitting air to the operator 22*a* positioned between the reaction plate 22*c* which is fixed in position and the movable lift plate 22*f* which is attached to the valve plug 22*d*. Once air is admitted to the operator 22*a* through inlet 22*h*, it will be seen that the valve plug 22*d* is moved away from the valve seat 22*g*, effectively opening it. It will be appreciated that the expansible operator system is simpler and more reliable than an air cylinder, especially where it is necessary to operate only in an emergency. The operator 22*a* also provides for intermediate positioning of the valve plug 22*d* as required during the diver controlled ascent. The valve plug 22*d* is guided in its movement by the valve guide 22which is in turn supported by a cage 22*j* which not only supports the valve guide, but also serves to protect the air connection and the valve plug against damage, particularly when the body settles to the bottom. This cage 22*j* extends to the interior of the buoy, providing space for sea water (or air) to flow in and out of the buoy compartments. Although an expansible operator is shown and is preferred for its simplicity and reliability, an air cylinder operator could also be utilized, or, alternatively, electric motor or hydraulic drives could also be fitted but with a corresponding increase in cost and loss in reliability.

Although, as has been mentioned, the semi-manual refloating of the buoy is preferred in order to reduce cost and minimize the possibility of damage to the buoy, it is possible to arrange the system already provided so as to permit automatic refloating of the buoy by reversing the operation of the valves. Since this inherently requires significantly more air than is provided in the preferred embodiment, additional air cylinders would be required in order to expel all of the air from the buoy and additional complicated apparatus would be needed in order to provide automatic refloating. In addition, since the position of the buoy after scuttling is not certain, automatic refloating might lead to an inversion of the buoy which would make righting of the buoy necessary before it could be reused. For these reasons, it has been determined that in the preferred embodiment a semi-manual refloating would be preferred.

The foregoing discussion of the preferred embodiment is intended for illustration and information only and not by way of limitation of the scope of the invention which is defined by the claims which follow.

What is claimed is:

1. A scuttling valve for admitting water to a submersible buoy or for releasing air from said buoy comprising:

a. a support plate adapted to be secured to an opening in said buoy, said support plate having an opening for passing said water or air, said opening serving as a valve seat;

b. an open cage means mounted on said support plate and surrounding said valve seat opening for providing free passageways, said cage being positioned with an exterior portion outside said buoy, and an interior portion inside said buoy;

c. a valve plug adapted to close said valve seat opening of (*b*), said plug fixedly mounted on a guide member which is arranged perpendicularly to said plug and valve seat and extends on both sides of said supporting plate of (*a*), said guide member being positioned by a valve guide secured to the exterior portion of said cage;

d. a fixed reaction plate mounted on the interior portion of said cage and having an opening for accepting and guiding the interior extending portion of said guide member of (*c*);

e. a spring means positioned between said reaction plate and said valve plug for resisting movement of said valve plug toward said reaction plate and for urging said valve plug against said valve seat;

f. a movable lift plate mounted perpendicularly on the interior end of said guide member and parallel to said reaction plate of (*d*);

g. a valve plug operator for positioning the movable valve plug relative to the valve seat by acting against the movable lift plate.

2. The scuttling valve of claim 1 wherein said valve plug operator comprises an inflatable air reservoir positioned between said movable lift plate and said fixed reaction plate whereby said lift plate can be moved away from said reaction plate by inflating said air reservoir.

3. The scuttling valve of claim 1 wherein said spring means is a helical spring.

4. The scuttling valve of claim 2 wherein said air reservoir is inflated by air supply means communicating with said reservoir.

5. A remote controlled self-scuttling mooring buoy comprising:

a. a hollow body member having a plurality of compartments therein;

b. a plurality of scuttling valves mounted on said body member for admitting water to said compartments and for releasing air therefrom, each of said valves including a support member including an opening and serving as a valve seat, valve plug means for closing said opening, a fixed reaction member and bias means positioned between said reaction member and said valve plug means for normally maintaining said valve plug means against said valve seat for closing said opening, and expandible means coacting with said valve plug means for positioning said valve plug means with respect to said opening in opposition to said bias;

c. mooring hook means for mooring engagement with a mooring line for securing a vessel to said buoy, said mooring hook means responsive to a signal for movement between a first position for securing said mooring line to said buoy and a second position in which it is adapted to release said mooring line from said mooring hook means;

d. receiving means for receiving a signal and commanding a response to said signal;

e. actuating means responsive to said receiving means for releasing said mooring line from said mooring hook means and opening said scuttling valves, thereby freeing said vessel from said buoy and sinking said buoy.

6. The buoy of claim 5 wherein said receiving means comprises a radio receiver for receiving a command signal.

7. The buoy of claim 5 wherein said actuating means comprises pressurized air containers adapted to supply air under pressure to said mooring hook means and said scuttling valves when said receiving means commands a response from said mooring hook means and said scuttling valves.

8. The buoy of claim 5 wherein said mooring hook means comprises a hook for receiving and securing said mooring line from said vessel and said hook releasing said mooring line when said actuating means which comprises an air-operated actuator is activated.

9. The buoy of claim 5 wherein said scuttling valves are adapted to open by said actuating means which comprises an air-operated actuator.

10. The buoy of claim 9 wherein said scuttling valves are constructed so as to provide for manual admission of pressurized air to said air-operated actuator.

* * * * *